US010125516B2

(12) United States Patent
Stehly

(10) Patent No.: US 10,125,516 B2
(45) Date of Patent: Nov. 13, 2018

(54) DEVICE FOR SETTING UP A DISMANTLABLE AND/OR FOLDABLE SHELTER

(71) Applicant: VITABRI, Besancon (FR)

(72) Inventor: Alain Stehly, Charnay (FR)

(73) Assignee: VITABRI, Besancon (FR)

( * ) Notice: Subject to any disclaimer, the term of this patent is extended or adjusted under 35 U.S.C. 154(b) by 181 days.

(21) Appl. No.: 14/899,468

(22) PCT Filed: Jun. 20, 2014

(86) PCT No.: PCT/FR2014/051537
§ 371 (c)(1),
(2) Date: Dec. 21, 2015

(87) PCT Pub. No.: WO2014/202914
PCT Pub. Date: Dec. 24, 2014

(65) Prior Publication Data

US 2016/0138296 A1 May 19, 2016

(30) Foreign Application Priority Data

Jun. 21, 2013 (FR) ..... 13 55921
Aug. 1, 2013 (FR) ..... 13 57659

(51) Int. Cl.

| | |
|---|---|
| ***E04H 15/02*** | (2006.01) |
| ***E04H 15/32*** | (2006.01) |
| ***E04H 15/50*** | (2006.01) |
| ***E04H 1/12*** | (2006.01) |
| *E04H 15/44* | (2006.01) |

(52) U.S. Cl.
CPC ..... *E04H 15/32* (2013.01); *E04H 1/1222* (2013.01); *E04H 1/1272* (2013.01); *E04H 15/02* (2013.01); *E04H 15/50* (2013.01); *E04H 15/44* (2013.01)

(58) Field of Classification Search
CPC ..... E04H 15/02; E04H 15/32; E04H 15/50; E04H 1/222; E04H 1/1272; E04G 1/20; E04G 1/22
USPC ..... 211/85.3, 85.7, 133.1, 182
See application file for complete search history.

(56) References Cited

U.S. PATENT DOCUMENTS 2,044,659 A 6/1936 Adams
2,836,860 A 6/1958 Staropoli
(Continued)

FOREIGN PATENT DOCUMENTS

DE 86 23 982 U1 3/1989
FR 2 753 220 A1 3/1998
FR 2 868 101 A1 9/2005

*Primary Examiner* — David R Dunn
*Assistant Examiner* — Danielle Jackson
(74) *Attorney, Agent, or Firm* — Andrew W. Chu; Craft Chu PLLC

(57) ABSTRACT

The device for setting up a dismountable and/or foldable shelter includes at least two vertical posts that are each equipped, at different levels, with at least two substantially horizontal arms having a free end which is provided with fasteners in the form of a clip. There is at least one telescopic longitudinal member provided, at each of its ends, with an articulated connector which engages with a junction ring that is mounted so as to move in translation on each of the two posts. The junction ring includes a device for preventing movement in translation along the post.

8 Claims, 2 Drawing Sheets

(56) References Cited

U.S. PATENT DOCUMENTS

| | | | | | |
|---|---|---|---|---|---|
| 4,078,633 | A * | 3/1978 | Fahy | E04G 1/20 | 182/145 |
| 4,256,201 | A * | 3/1981 | Neighbors | E04G 1/34 | 182/150 |
| 4,396,092 | A * | 8/1983 | Thompson | E04G 1/24 | 182/150 |
| 4,823,913 | A * | 4/1989 | Riegel, Jr. | B25H 1/06 | 182/182.5 |
| 6,478,039 | B2 * | 11/2002 | Suh | E04H 15/50 | 135/120.3 |
| 7,240,685 | B2 * | 7/2007 | Seo | E04H 15/50 | 135/120.3 |
| D584,833 | S * | 1/2009 | Smith | D25/68 | |
| 7,637,275 | B2 * | 12/2009 | Stehly | E04H 15/46 | 135/114 |
| D630,289 | S * | 1/2011 | Stehly | D21/839 | |
| 8,459,602 | B2 * | 6/2013 | Herskovic | A61G 7/0503 | 248/229.13 |
| 8,662,096 | B2 * | 3/2014 | Stehly | E04H 15/50 | 135/114 |
| 9,394,719 | B2 * | 7/2016 | Choi | A47B 3/083 | |
| 2010/0282283 | A1 | 11/2010 | Bauer | | |

* cited by examiner

DEVICE FOR SETTING UP A DISMANTLABLE AND/OR FOLDABLE SHELTER

CROSS-REFERENCE TO RELATED APPLICATIONS

See Application Data Sheet.

STATEMENT REGARDING FEDERALLY SPONSORED RESEARCH OR DEVELOPMENT

Not applicable.

THE NAMES OF PARTIES TO A JOINT RESEARCH AGREEMENT

Not applicable.

INCORPORATION-BY-REFERENCE OF MATERIAL SUBMITTED ON A COMPACT DISC OR AS A TEXT FILE VIA THE OFFICE ELECTRONIC FILING SYSTEM (EFS-WEB)

Not applicable.

STATEMENT REGARDING PRIOR DISCLOSURES BY THE INVENTOR OR A JOINT INVENTOR

Not applicable.

BACKGROUND OF THE INVENTION

1. Field of the Invention

The present invention falls within the field of dismantlable and foldable shelters designed to be used outdoors, in particular of the folding tent type.

The invention particularly relates to a device for setting up a shelter.

Such a device will preferably, but not exclusively, be applicable in the arrangement of equipment offering space and a storage, stowage or product presentation surface.

2. Description of Related Art Including Information Disclosed Under 37 CFR 1.97 and 37 CFR 1.98.

In a known manner, during demonstrations such as expositions, markets or similar occasions, each exhibitor and/or businessperson sets up a booth, or shelter, that comprises a framework made up of a dismantlable structure, and associated with a tarp or similar means. There are several types of dismantlable structures, and most often such structures are provided to be quickly and easily set up and dismantled.

Dismantlable structures, which are primarily made from metal, include those made up of nesting elements, and those made up of deployable elements.

Structures with deployable elements assume the form of a set of articulated profiles, of the pantograph type, to allow the transition from a deployed position suitable for supporting a tarp or similar member, to a folded position for transport.

These structures with deployable elements comprise posts, generally four or six, designed to make up the legs of the structure, and profiles connecting two adjacent posts to form tie-beams, and optionally profiles connected to one another and each of the posts to form rafters. In the folded position, the posts are positioned parallel to one another, while the profiles are folded against one another between said posts. Furthermore, said posts can be provided to be telescoping.

These deployable structures have many advantages relative to the other structure types, in particular regarding the ease and speed of installation. However, they are limited regarding the arrangement possibilities, in particular by adding a horizontal peripheral wall, for example to form a counter or bar, a tray, or an outward extension of the shelter, and/or a vertical wall to form a separation between the inside and the outside of said shelter, or to compartmentalize the inner space of said shelter.

One solution is described in document FR 2,868,101, targeting a structure made up of a vertical upright along which two upper and lower arms are in particular articulated, at one end, the opposite end of which is able to cooperate by fastening with a post, through an assembly by pinching. To that end, each arm comprises a pair of profiles spaced apart and extending in parallel, said end of which grips said post on either side. Thus, the upper arm can serve as a support for a surface, in particular a plate, while the lower arm ensures the geometry of the structure thus formed. By fixing two identical structures on two adjacent beams, it is then possible to produce a counter or shelf, extending both toward the inside and outside relative to the structure of the shelter.

More specifically, the ends of the profiles fastened with the posts each form part of the jaw of a clip. The inner surface of each part is configured to become complementary with respect to the outer section of the posts of the shelter. In particular, in the case of hexagonal posts, each part inwardly has two faces inclined relative to one another and ends with a lug at their free end. Thus, it is possible to orient the structure by allowing it to rotate around the post, according to angular portions corresponding to said section. In the case of a hexagonal section, it is then possible to orient the arms angularly every 60°.

However, although such a solution forms bases each connected to a post of the shelter, it does not provide optimal stability of the surface that it receives, in particular lateral stability. Furthermore, the surface must necessarily bear on the horizontal arms, limiting the possible configurations. In short, set up is considerably limited in terms of possible arrangements.

Other solutions, in particular using telescoping beams directly connected to the members of the structure of the shelter, are described in documents FR 2,753,220, U.S. Pat. No. 2,836,860 and DE 86 23 982 U1. These solutions once again do not make it possible to obtain a modular arrangement and stability of the elements thus attached on the structure of the shelter.

BRIEF SUMMARY OF THE INVENTION

The present invention aims to offset the drawbacks of the state of the art, by proposing a device for setting up a shelter, made up of at least one beam connecting each of the aforementioned uprights using junction rings. The latter in particular ensure the vertical indexing of the height of said beam along each upright. Furthermore, such a beam is advantageously provided to be telescoping, so as to adapt lengthwise based on the angular orientation of the structure formed by the uprights and the arms.

To that end, such a device for setting up a dismantlable and/or foldable shelter comprises at least two vertical uprights each equipped, at different levels, with at least two substantially horizontal arms, including a free end provided with fastening means in the form of a clip, characterized in that it also includes at least one telescoping beam provided at each of its ends with articulated connection means with a junction ring mounted in translation on each of the two uprights, this junction ring including means for preventing translational movement along said upright.

Advantageously, several junction rings can be mounted along an upright for receiving more than one telescoping beam, at different levels.

It is thus possible to position several beams quickly and easily above one another. Such beams may be called upon to extend horizontally, but also oriented in an inclined manner, owing to the articulated connection means. Furthermore, the telescoping nature of said beam makes it possible to adapt its length based on its position.

The device according to the invention makes it possible to form at least one support bar for surface or support, said bar being able to be turned toward the inside or the outside of the shelter. In the case of a rigid surface, indexed at mid-height, the device can form a counter, offset inwardly or outwardly relative to its support structure. Several bars make it possible to form shelves or a wardrobe.

Thus, the invention makes it possible to facilitate the addition of a horizontal wall on the periphery, for example, to form a counter or bar, shelves or a wardrobe.

BRIEF DESCRIPTION OF THE SEVERAL VIEWS OF THE DRAWINGS

Other features and advantages of the invention will emerge from the following detailed description of non-limiting embodiments of the invention, in reference to the appended figures.

DETAILED DESCRIPTION OF THE INVENTION

Figure 1:
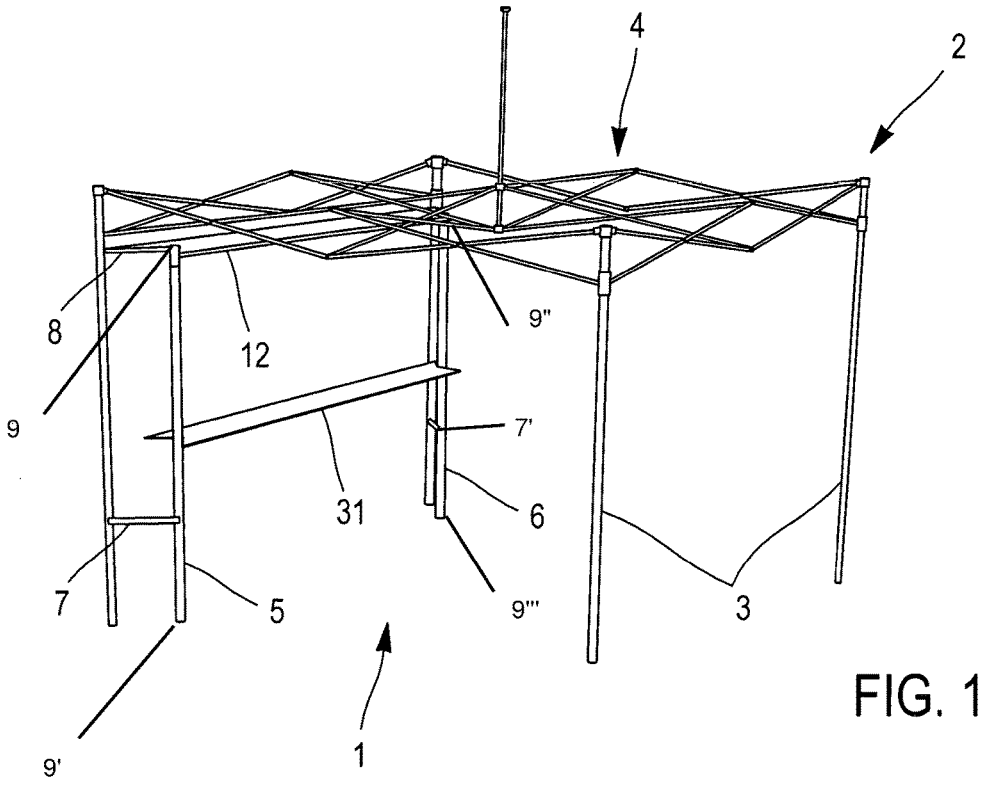
FIG. 1 diagrammatically shows perspective view of a shelter provided with an example setup device according to the invention.
Figure 2:
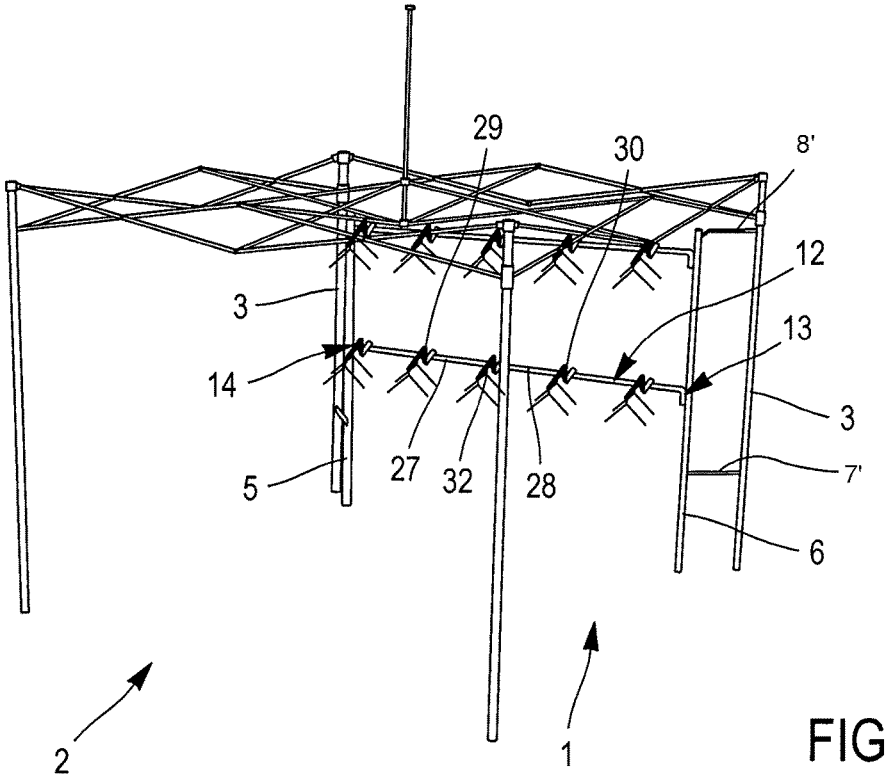
FIG. 2 shows another perspective view similar to FIG. 1 illustrating another example setup device according to the invention.
Figure 3:
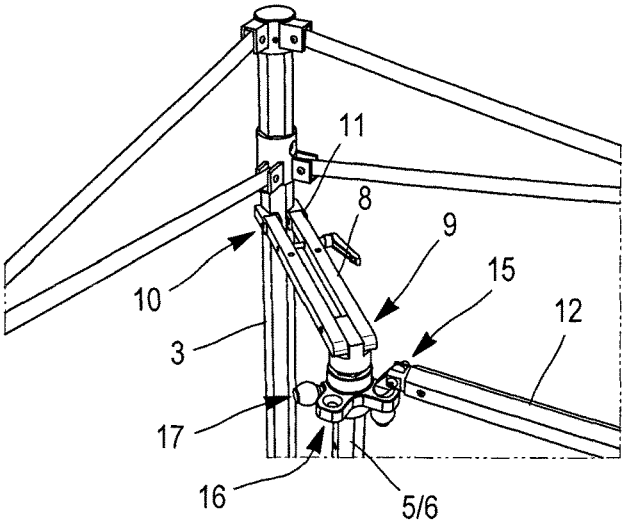
FIG. 3 is a detailed illustration of a perspective view, illustrating the connection between the upper post arm and the vertical upright, as well as that between the telescoping beam and a junction ring on said upright.

As shown in the attached figures, the present invention relates to a device 1 for setting up a shelter 2 of the dismantlable and/or foldable type, which, as shown in FIGS. 1 and 2, essentially includes at least four posts 3 on which a deployable and/or dismantlable structure 4 rests for receiving and stretching a tarp or canvas forming the roof (not shown).

Thus, the set up device 1 according to the invention includes at least two vertical uprights 5, 6 each equipped, at different levels, with at least two arms, including a lower arm 7, 7' and an upper arm 8, 8'. These arms are able to extend substantially horizontally relative to these uprights 5, 6, to which they are secured at one end 9, 9", opposite a bottom end 9', 9'" preferably in an articulated manner.

At their free end 10, these arms 7, 8 are provided with clip-forming fastening means 11. Through the latter, the arms 7, 8 and therefore the uprights 5, 6 can be attached, in different angular positions, around the posts 3 of the shelter 2.

According to the preferred embodiment, the arms 7, 8 extend horizontally or substantially horizontally, while the uprights 5, 6 extend vertically or substantially vertically. The plane formed by each pair of arms 7, 8 and its corresponding post 5 or 6 then extends vertically or substantially vertically, passing through the longitudinal median axis of each post 3 on which they are attached.

Furthermore, according to the invention, the set up device 1 also includes a telescoping beam 12 provided, at each of its ends 13, 14, with articulated connection means 15 cooperating with the junction ring 16 included by each of the uprights 5, 6.

More particularly, such a junction ring 16 is mounted in translation along an upright 5, 6, in particular a ring on each upright 5, 6. It includes immobilizing means 17 allowing it to be positioned at different levels along such an upright 5, 6.

Preferably, said immobilizing means 17 consists of indexing means for indexing the position of the junction ring 16 along such an upright 5, 6.

More particularly, such a junction ring 16 can be provided with an indexing elastic return finger 18 whereof one end can engage in one of the multiple holes 19 arranged along the upright 5, 6.

Of course, such immobilizing means 17 can assume other forms, for example fastening means by gripping. Furthermore, several junction rings 16 can be mounted on an upright 5, 6 to receive several telescoping beams 12.

According to the preferred embodiment, an upright 5, 6 has a polygonal outer section. Said ring 16 then consists of a sheath, with a globally cylindrical shape and provided to be hollow, designed to be crossed through from one end to the other by the upright 5, 6 on which it is translatably mounted. Furthermore, the inner section of the sheath has a shape complementary to, and larger dimensions of the outer section than, the shape and dimensions of said upright 5, 6. According to the embodiments shown in the figures, the upright 5, 6 can have a polygonal section, in particular hexagonal.

Furthermore, according to one advantageous embodiment, a junction ring 16 includes, on its periphery, arranged protruding, at least one lug 20 forming an eyelet and including a hole 22 for receiving a pin 23, with which the articulated connecting means 15 is provided ending, each of the ends 13, 14, a telescoping beam 12. The cooperating assembly of the pin 23 within the hole 22 then forms a hinge pin.

More particularly, such a pin 23 extends from a junction 24, forming a base, mounted articulated, using the yoke 25, on this end 13, 14 of the beam 12. In particular, said junction 24 can assume the form of a tab whereof the lower end constitutes the pin 23, while the opposite end, situated higher, cooperates with said yoke 25. Furthermore, this cooperation can be done through a pivot link, in particular by means of fastening by screwing using a screw/nut pair, said screw crossing through said yoke 25 and said opposite end of said tab.

Figure 4:
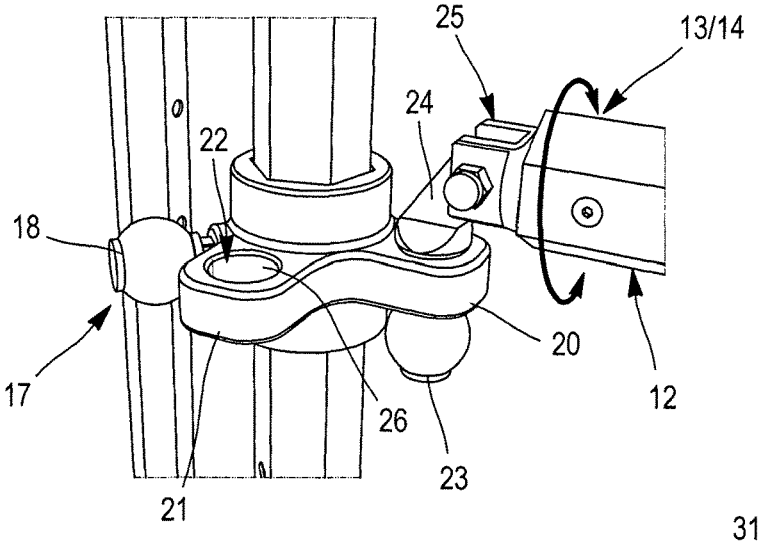
FIG. 4 is a detailed illustration of a perspective view, more particularly illustrating this connection between the telescoping beam and a junction ring on the upright.
Figure 5:
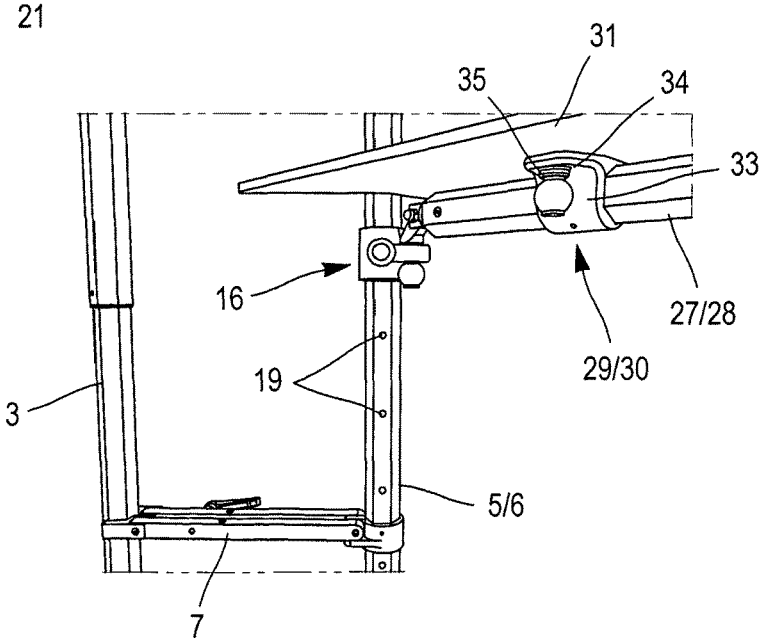
FIG. 5 corresponds to a perspective view of an illustration similar to FIG. 3, seen from another angle.

According to one additional feature, said yoke 25 can be mounted articulated, pivoting relative to the end 13, 14 of the beam 12. In particular, the rotation can be done around the longitudinal axis of said beam 12. Such a pivot link is shown diagrammatically by arrows in FIG. 4.

It should be noted that the rod forming the pin 23 can be kept in the hole 22 of a lug 20 of the junction ring 16 using a lever pin or similar member, just as it can assume the form of a threaded rod for receiving a tightening nut, as shown in the drawings.

Owing to these articulated connection means 15, a beam 12 can extend horizontally or inclined between two uprights 5, 6.

Furthermore, it greatly facilitates the assembly of this telescoping beam 12 on these uprights 5, 6, the operator not being constrained in positioning them relative to one another.

It should also be noted that the junction 24 from which the rod forming the pin 23 extends can be configured in the form of a cone trunk, like the mouth 26 of the hole 22 in the lugs 20, 21, favoring self-centering of the parts relative to one another and their assembly without play. In particular, the frustoconical walls extend decreasing from the upper opening of said hole 22, and in a complementary manner, at the rod forming the pin 23.

The telescoping beam 12 may be made up of two or more tubular profiles 27, 28 that can be nested in one another through complementary sections. In particular, a first profile, sliding inside the second profile, then has an outer section with a complementary shape and dimensions smaller than those of said second profile.

It will be noted that the posts 3, as well as the uprights 5, 6, can also be provided to be telescoping, so that they can be folded and deployed. Furthermore, it is possible to adjust the height of the uprights 5, 6, based on the level difference of the ground, but also to orient the beam 12 differently, in particular when the latter is positioned on a slant or diagonally between the junction rings 16.

Furthermore, the telescoping nature of the beam 12 makes it possible to adapt the length thereof, in particular during its positioning on a slant between the uprights 5, 6, or based on the angular position of said arms 7, 8.

Furthermore, according to the invention, one or more fastening supports 29, 30 are mounted on this telescoping beam 12, on which supports different accessories can be attached, for example a tray 31, a wardrobe part 32, etc.

Such fastening supports 29, 30 can more particularly assume the form of a ring 33, the inner section of which is adjusted to the outer section of one or the other of the profiles 27, 28 of the telescoping beam 12. Preferably, in this respect, these profiles 27, 28 have a polygonal section facilitating the angular indexing of the fastening supports 29, 30 around the telescoping beam 12.

Said ring 33 can be secured to a fastening plate 34 on which, owing to appropriate fastening holes 35, the aforementioned accessories can easily be attached.

Essentially, it should be noted that the set up device 1 according to the invention advantageously contributes to ballasting the shelter 2 on the posts to which it is attached. This ballast becomes greater as accessories (trays, wardrobe, etc.) are added and loaded. This results in increased safety of such dismantlable and/or deployable shelters 2.

According to the preferred embodiment, the profiles making up the arms, uprights and beam can be made from a metal material, as can at least some of the articulations, while the other elements can be made from a plastic or composite material. Of course, the invention is in no way limited and various changes can be made thereto in terms of the shapes, materials and combinations of these various elements without going beyond the scope and spirit of the invention.

I claim:

1. A set up device for a shelter, the device comprising:

a first vertical post of the shelter;

a first vertical upright having a first one end and a first bottom end opposite said first one end;

a first horizontal upper arm having a first free end and being attached to said first vertical upright closer to said first one end than said first bottom end;

a first horizontal lower arm attached to said first vertical upright closer to said first bottom end than said first free end;

a first fastening means for said first horizontal upper arm to said first vertical post at said first free end;

a second vertical post of the shelter;

a second vertical upright having a second one end and a second bottom end opposite said second one end;

a second horizontal upper arm having a second free end and being attached to said second vertical upright closer to said second one end than said second bottom end;

a second horizontal lower arm attached to said second vertical upright closer to said second bottom end than said second free end;

a second fastening means for said second horizontal upper arm to said second vertical post at said second free end;

a telescoping beam having a first beam end and a second beam end;

a first articulated connection means for said first beam end and said first vertical upright;

a second articulated connection means for said second beam end and said second vertical upright;

a first junction ring mounted on said first vertical upright;

a first means for preventing translational movement of said first junction ring along said first vertical upright;

a second junction ring mounted on said second vertical upright; and a second means for preventing translational movement of said second junction ring along said second vertical upright.

2. The set up device, according to claim 1, wherein each junction ring is comprised of a sheath and a plurality of lugs around said sheath, wherein at least one lug engages a respective articulated connection means for a corresponding beam end of said telescoping beam.

3. The set up device, according to claim 1, wherein each means for preventing translational movement comprises an indexing means for positioning of a corresponding junction ring along a respective vertical upright and a plurality of holes along said respective vertical upright.

4. The set up device, according to claim 3, wherein each junction ring is provided with an indexing elastic return finger, and wherein each indexing means for positioning is comprised of an end of a corresponding return finger engaged in one of said plurality of holes.

5. The set up device, according to claim 2, wherein each lug is comprised of an eyelet with a hole, and wherein said respective articulated connection means is comprised of a pin removable engaged to a respective hole of a corresponding lug and attached to a respective beam end of said telescoping beam.

6. The set up device, according to claim 5, wherein said respective articulated connection means is further comprised of a yoke, said yoke having a junction extended to said pin and being connected to a respective beam end of said telescoping beam.

7. The set up device, according to claim 1, wherein said telescoping beam is comprised of a plurality of tubular profiles, said tubular profiles being nested in one another in a telescoping engagement.

8. The set up device, according to claim 1, further comprising: at least one fastening support mounted on said telescoping beam so as to receive accessories in said at least one fastening support.

* * * * *